US009235160B2

(12) United States Patent
Kanai

(10) Patent No.: US 9,235,160 B2
(45) Date of Patent: Jan. 12, 2016

(54) DEVELOPER REMAINDER AMOUNT DETECTION SYSTEM AND IMAGE FORMING APPARATUS

(75) Inventor: Ryosuke Kanai, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 213 days.

(21) Appl. No.: 13/295,550

(22) Filed: Nov. 14, 2011

(65) Prior Publication Data

US 2012/0121275 A1 May 17, 2012

(30) Foreign Application Priority Data

Nov. 15, 2010 (JP) ..... 2010-254623

(51) Int. Cl.
*G03G 15/08* (2006.01)

(52) U.S. Cl.
CPC ..... *G03G 15/086* (2013.01); *G03G 15/0831* (2013.01); *G03G 15/0851* (2013.01); *G03G 15/0856* (2013.01); *G03G 15/0848* (2013.01); *G03G 15/0865* (2013.01)

(58) Field of Classification Search
CPC ..... G03G 15/0831; G03G 15/0856; G03G 15/086; G03G 2215/0875
USPC ..... 399/27, 53
See application file for complete search history.

(56) References Cited

U.S. PATENT DOCUMENTS

| | | | | |
|---|---|---|---|---|
| 6,615,001 | B2 | 9/2003 | Otomo et al. | |
| 6,944,410 | B2 | 9/2005 | Naito et al. | |
| 2002/0048463 | A1 | 4/2002 | Otomo et al. | |
| 2004/0105690 | A1 | 6/2004 | Naito et al. | |
| 2007/0206966 | A1 * | 9/2007 | Komiya et al. | 399/27 |
| 2009/0003884 | A1 * | 1/2009 | Kawamura et al. | 399/252 |

FOREIGN PATENT DOCUMENTS

| | | | |
|---|---|---|---|
| JP | 6-130817 | A | 5/1994 |
| JP | 2002-127379 | A | 5/2002 |
| JP | 2002-196576 | A | 7/2002 |
| JP | 2003-323036 | A | 11/2003 |
| JP | 2004-170946 | A | 6/2004 |
| JP | 2005-164920 | A | 6/2005 |

* cited by examiner

*Primary Examiner* — Benjamin Schmitt

(74) *Attorney, Agent, or Firm* — Fitzpatrick, Cella, Harper & Scinto

(57) ABSTRACT

A detecting system for detecting a developer remainder in a developer container accommodating a developer to be used for developing an electrostatic latent image formed on an image bearing member. The detecting system includes first, second and third electrode members provided in the developer container, an AC voltage source for applying an AC voltage to the third electrode member, a first electrostatic capacity detector for detecting a first electrostatic capacity between the first electrode member and the third electrode member, and a second electrostatic capacity detector for detecting a second electrostatic capacity between the second electrode member and the third electrode member. In addition, a developer remainder detector corrects the first electrostatic capacity on the basis of the second electrostatic capacity and detects a developer remainder of the developer container from a result of correction of the first electrostatic capacity. The first electrostatic capacity is corrected on the basis of the second electrostatic capacity.

11 Claims, 7 Drawing Sheets

DEVELOPER REMAINDER AMOUNT DETECTION SYSTEM AND IMAGE FORMING APPARATUS

FIELD OF THE INVENTION AND RELATED ART

The present invention relates to a developer remainder amount detection system, and an image forming apparatus.

An electrophotographic image forming apparatus has a developing means (developing device), which has a developer container in which dry and powdery developer is stored. The developer in the developer container is consumed for image formation. While the image forming apparatus is used for image formation, the amount of the developer in the developer container successively reduces. Then, as the developer is consumed, the developer container has to be replenished with developer. Thus, an electrophotographic image forming apparatus is provided with a developer remainder detecting means. Further, an image forming apparatus of the cartridge type, that is, an image forming apparatus structured so that a process cartridge or a development cartridge is removably installable in its main assembly, has to be provided with a developer remainder amount detecting means in order to replace the cartridge therein with a brand-new cartridge as the cartridge therein runs out of the developer.

Here, a process cartridge and a development cartridge are cartridges that contribute to an image formation process for forming an image on recording medium, by being removably installed in the main assembly of an image forming apparatus. A process cartridge is made up of an image bearing member, one or processing means for processing the image bearing member, and a cartridge (shell) in which the image bearing member and processing means are integrally disposed. It can be removably installed in the main assembly of an image forming apparatus.

A process cartridge having both an image bearing member and a developing means is referred to as a process cartridge of the integration type, whereas a process cartridge having an image bearing member and one or more processing means other than a developing means is referred to as a process cartridge of the separation type.

A development cartridge has a developer bearing member and a developer container. The developer bearing member is for delivering developer to an image bearing member. The developer container stores dry and powdery developer which is borne by the developer bearing member and delivered by the developer bearing member to develop an electrostatic latent image formed on the image bearing member. A development cartridge is removably installable in the main assembly of an image forming apparatus. In the case of an image forming apparatus of the transfer type, which employs a development cartridge, its image bearing member is attached to the main assembly of the apparatus, or the cartridge supporting member of the apparatus. In the case of an image forming apparatus which employs a process cartridge of the separation type, its image bearing member is a part of the process cartridge.

One of the widely known means for detecting the amount of the developer remainder in the developer container of the developing means of the main assembly of an image forming apparatus, or in the developer container of the process cartridge or development cartridge in the main assembly of an image forming apparatus, is the developer remainder amount detecting means which determines the amount of the toner in a container, based on the electrostatic capacity of a virtual condenser made up of a pair of electrodes positioned in the container so that the amount of the electrostatic capacity of the virtual condenser is proportional to the amount of the developer in the container. This developer remainder amount detecting means will be referred to simply as developer remainder amount detecting means of the electrostatic capacity detection type.

As the developer remainder amount detecting means of the electrostatic capacity detection type, there are those proposed in Japanese Laid-open Patent Applications H06-130817, and 2003-323036 which were applied by the applicants of the present invention. In the case of the art disclosed in Japanese Laid-open Patent Application H06-130817, an electrically conductive rod is placed in the developer container of a process cartridge so that it is in the adjacencies of the developer bearing member in the container, and the amount of the developer remainder in the container is determined based on the detected changes in the amount of the electrostatic capacity between the developer bearing member and electrically conductive rod. In the case of the art disclosed in Japanese Laid-open Patent Application 2003-323036, two electrodes are placed in the developer container, and the amount of the developer in the container is determined based on the changes in the detected amount of the electrostatic capacity between the developer bearing member and one of the electrodes, or between the two electrodes.

The art disclosed in Japanese Laid-open Patent Application 2003-323036 places two electrodes in the developer container. Therefore, it is wider in the developer amount range in which the amount of the developer in the developer container can be accurately determined. Therefore, it is possible to successively and accurately inform a user of the developer remainder amount in the developer container. Further, the art makes it possible to successively inform a user of the developer remainder amount in a cartridge even if the cartridge is large in developer capacity. That is, it is a very useful art.

SUMMARY OF THE INVENTION

The present invention is made to further improve the above described prior art. Thus, one of the primary objects of the present invention is to provide a developer remainder amount detecting system which can successively detect the developer remainder amount in a developer container and is significantly higher in accuracy than any developer remainder amount detecting system in accordance with the prior art, and an image forming apparatus having a developer remainder amount detecting system in accordance with the present invention.

According to an aspect of the present invention, there is provided a detecting system for detecting a developer remainder in a developer container accommodating a developer to be used for developing an electrostatic latent image formed on an image bearing member, said detecting system comprising first, second and third electrode members provided in said developer container; an AC voltage source for applying an AC voltage to third electrode member; a first electrostatic capacity detector for detecting a first electrostatic capacity between said first electrode member and said third electrode member by detecting an AC current induced in said first electrode member when the AC voltage is applied to said third electrode member; a second electrostatic capacity detector for detecting a second electrostatic capacity between said second electrode member and said third electrode member by detecting an AC current induced in said second electrode member when said AC voltage is applied to said third electrode member; and a developer remainder detector for correcting the first electrostatic capacity detected by said first electrostatic capacity detector on the basis of the second electrostatic capacity detected by said second electrostatic capacity detector, and for detecting a developer remainder of said developer container from a result of correction of the first electrostatic capacity.

According to another aspect of the present invention, there is provided an image forming apparatus using such a detecting system.

According to the present invention, the amount of the developer in a developer container is determined based on the value obtained by compensating the amount of the first electrostatic capacity detected by the first electrostatic capacity, for the effect of the second electrostatic capacity, based on the amount of the second electrostatic capacity detected by the second electrostatic capacity detecting portion. Therefore, the present invention can provide a developer remainder amount detecting device which can successively determine the developer remainder amount in a developer container and is significantly higher in accuracy than any developer remainder amount detecting apparatus in accordance with the prior art.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described in detail with reference to the appended drawings.

Embodiment 1

(1) Image Forming Apparatus

Figure 1:
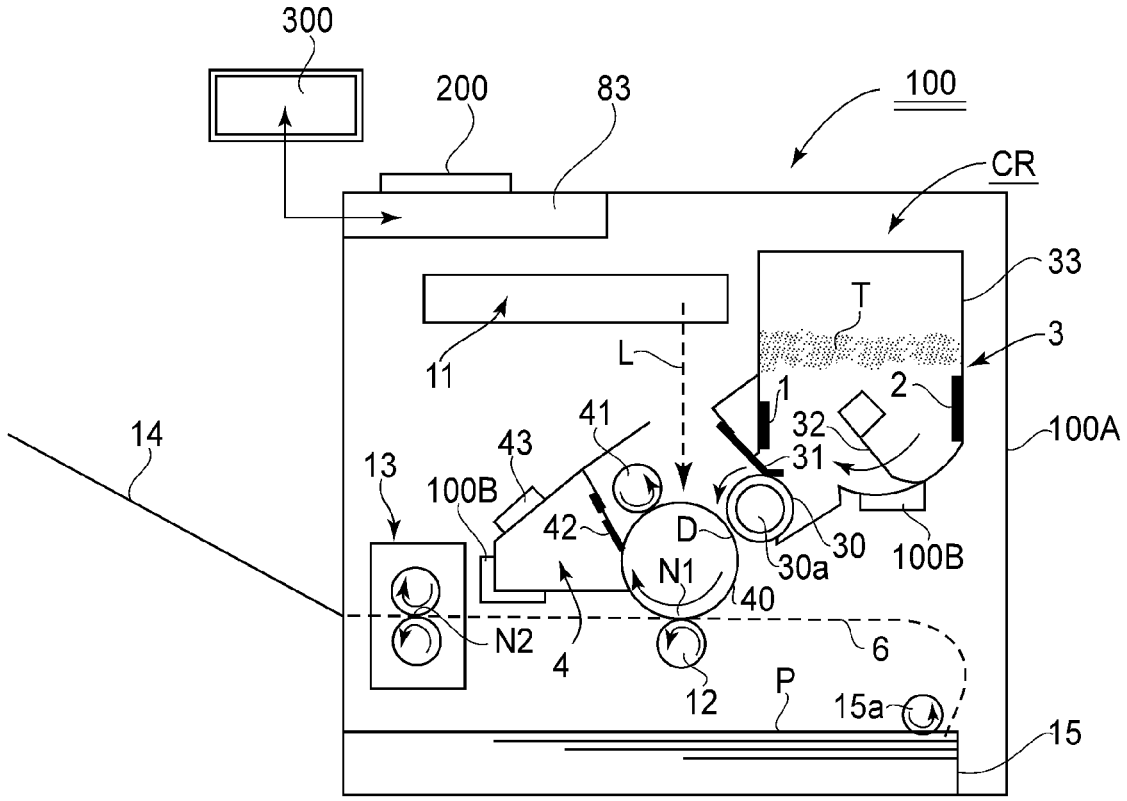
FIG. 1 is a schematic sectional view of the image forming apparatus in the first preferred embodiment of the present invention, and shows the general structure of the apparatus.
Figure 2:
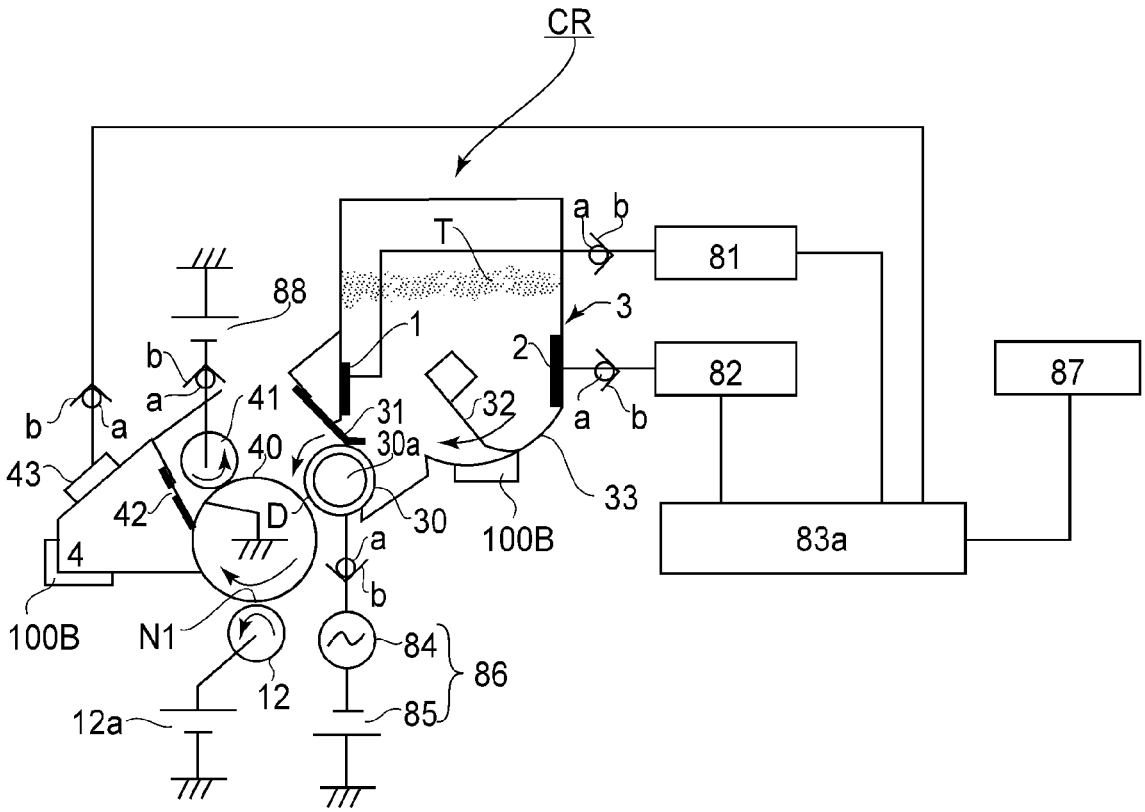
FIG. 2 is a combination of the process cartridge and its adjacencies in the image forming apparatus shown in FIG. 1, and a block diagram of the control system of the apparatus.

FIG. 1 is a schematic sectional view of the image forming apparatus in the first preferred embodiment of the present invention, and shows the general structure of the apparatus. FIG. 2 is a combination of the process cartridge and its adjacencies in the apparatus shown in FIG. 1, and a block diagram of the control system of the apparatus. An apparatus 100 is an electrophotographic laser beam printer of the so-called dry type. It employs a process cartridge which is removably installable in the apparatus 100. The apparatus 100 electrophotographically forms an image on a sheet P of recording medium, according to the image formation data (electrical image formation signals) inputted into its control section 83 (control circuit having CPU) from an external host apparatus 300 such as a personal computer, an image reader, a facsimile machine (from which data are being transmitted), and the like.

The control section 83 exchanges various information, which is in the form of an electrical signal, with the control panel 200 and/or the host apparatus 300. Further, it integrally controls the image forming operation of the apparatus 100 according to preset control programs and referential tables.

The apparatus 100 has a rotatable electrophotographic photosensitive drum 40 as an image bearing member. The drum 40 is rotationally driven at a preset speed in the clockwise direction, that is, the direction indicated by an arrow mark. The apparatus 100 has also a charging means 41, an exposing means 11, a developing means 3, a transferring means 12, and a cleaning means 4, which are processing means for processing the drum 40. The processing means are in the adjacencies of the peripheral surface of the drum 4, and are in the listed order.

In this embodiment, the charging means 41 is in the form of a roller (charge roller which is electrically conductive). It is in contact with the peripheral surface of the drum 40. To the charging means 40, a preset bias is applied from a charge bias applying means 88, whereby the peripheral surface of the drum 40 is uniformly charged to a preset polarity (negative in this embodiment) while the drum 40 is rotated.

The exposing means 11 is a laser scanner. It scans the uniformly charged area of the peripheral surface of the drum 40 with a beam L of laser light which it outputs while modulating the beam with the image formation data inputted from the control section 83 while the drum 40 is rotated. As a result, a latent image (electrostatic latent image), which reflects the image formation data, is formed on the scanned portion of the uniformly charged area of the peripheral surface of the drum 40. In this embodiment, a latent image is a negative image of a visible image into which it is going to be developed.

A developing device 3 uses single-component toner which is dry, powdery, electrically nonconductive, and magnetic. It reversely develops an electrostatic latent image, with no contact between its developer bearing member and the peripheral surface of the drum 40 of the apparatus 100 (jumping development method). It has a development sleeve 30, a magnetic roller 30*a*, and a developer container 33. The development sleeve 30 is a developer bearing member. The toner T in the developer container 33 is borne on the peripheral surface of the development sleeve 30, and is conveyed to be delivered to the peripheral surface of the drum 40. The magnet roller 30*a* is a magnetic field generating means, and is in the internal hollow of the sleeve 30. It is stationary. The developer container 33 stores the toner T, which is to be supplied to the sleeve 30.

The developing device 3 has also a stirring member 32 and a development blade 31. The stirring member 32 is rotatable (movable), and conveys the toner T in the container 33 to the development sleeve 30 while stirring the toner T. The development blade 31 is a member for regulating in thickness the layer of the toner T on the peripheral surface of the sleeve 30, by being placed virtually in contact with the peripheral surface of the development sleeve 30.

The development sleeve 30 is made up of an electrically conductive and nonmagnetic roller as a substrate, and a layer of resin coated on the peripheral surface of the electrically conductive roller. The development sleeve 30 is disposed in such a manner that it is parallel to the drum 40, and also, that there is a microscopic gap between the peripheral surface of the drum 40 and the peripheral surface of the development sleeve 30. The development sleeve 30 is rotated in the clockwise direction, that is, the direction indicated by the arrow mark, at a preset speed. As the development sleeve 30 is rotated, some of the toner T in the container 33 is made to be borne, as a toner layer, by the peripheral surface of the development sleeve 30, by the magnetic force of the magnetic roller 30*a*, and is conveyed toward the development blade 31 by the rotation of the development sleeve 30. Then, as the development sleeve 30 is further rotated, the toner T on the peripheral surface of the development sleeve 30 is formed by the development blade 31, into a toner layer with a preset thickness, and then, is conveyed further toward the gap between the blade 31 and development sleeve 30 by the rotation of the development sleeve 30.

Then, when the toner layer on the peripheral surface of the development sleeve 30 is moved through the gap between the blade 31 and development sleeve 30 by the rotation of the development sleeve 30, it is reduced in thickness to a preset value while the toner particles in the toner layer are charged to a preset polarity by the friction between the toner layer and blade 31. In this embodiment, the toner particles are charged to the negative polarity, which is the same polarity as that to which the drum 40 is charged. Then, as the development sleeve 30 is further rotated, the portion of the toner layer, which has just been reduced in thickness, and in which the toner particles have just been negatively charged, is moved by the rotation of the development sleeve 30 to the development station D, which is where the distance between the peripheral surface of the development sleeve 30 and the peripheral surface of the drum 40 is the smallest. To the development sleeve 30, a development bias (development voltage), which is a combination of a preset alternating voltage and a preset direct current voltage is applied from a development bias applying means 86, which has an alternating voltage power source 84 and a direct current voltage power source 85.

The application of the above-described development bias to the development sleeve 30 causes the toner T on the development sleeve 30 to adhere to the exposed points (pixels) of the latent image on the peripheral surface of the drum 40. As a result, the latent image is reversely developed into a visible image, that is, an image formed of toner. As for the toner particles on the peripheral surface of the development sleeve 30, which were not consumed for the development of the latent image are returned into the container 33 by the further rotation of the development sleeve 30.

Meanwhile, a sheet feeder roller 15*a* is driven with a preset control timing, whereby one of the stacked sheets P of recording medium in a sheet feeder cassette 15 is moved out of the cassette 15 while being separated from the rest, and is conveyed to a transferring means 12 through a recording medium conveyance path 6. The transferring means 12 in this embodiment is in the form of a roller (transfer roller: electrically conductive roller), which is in contact with the peripheral surface of the drum 40. That is, the area of contact between the drum 40 and roller 12 is a transfer nip N1. The sheet P of recording medium is conveyed to the nip N1 with a preset timing, and then, is conveyed through the nip N1 while remaining pinched between the drum 40 and roller 12.

While the sheet P of recording medium is conveyed through the nip N1 while remaining pinched between the drum 40 and roller 12, a transfer bias, which is opposite in polarity to the electrostatic charge of the toner, is applied to the roller 12 from a transfer bias applying means 12*a*. As a result, the toner image on the peripheral surface of the drum 40 is electrostatically transferred onto the sheet P as if it is peeled away from the peripheral surface of the drum 40. After the passage of the sheet P through the nip N1, the sheet P is separated from the peripheral surface of the drum 40, and is introduced into a fixing means 13, which is a thermal fixing device. Then, the sheet P is conveyed through the fixation nip N2 of the fixing device 13 while remaining pinched between a pair of fixation rollers. While the sheet P is conveyed through the fixation nip N, the unfixed toner image on the sheet P is fixed to the sheet P by the heat and pressure applied by the fixing device 13. Then, the sheet P is discharged as a finished print into a delivery tray 14.

After the separation of the sheet P of recording medium from the drum 40, the drum 40 is cleaned by the cleaning means 4: the residual adherents such as the transfer residual toner, paper dusts, and the like, are removed by the cleaning means 4 so that the drum 40 can be repeatedly used for image formation. The cleaning means 4 in this embodiment is a cleaning apparatus of the so-called blade type, which has an elastic blade 42 (cleaning blade) as a cleaning member.

(2) Process Cartridge

The four image forming devices, more specifically, the drum 40, charge roller 41, developing device 3, and cleaning device 4, of the apparatus 100 in this embodiment, are integrally disposed in a cartridge, making up a process cartridge CR which is removably installable in the cartridge chamber 100B of the main assembly 100*a* of the apparatus 100, through preset installation/removal steps. The cartridge CR has an information storage means 43 (information storing second means), which is a nonvolatile and re-writable memory, in which various information about the cartridge CR is stored, and from which various information about the cartridge CR is read.

After the proper installation of the cartridge CR into the cartridge chamber 100B, the driving force input portion (unshown) of the cartridge CR is in a preset mechanical engagement with the driving force output portion (unshown) of the apparatus main assembly 100A, and further, the various electrical contacts a of the cartridge CR are electrically in contact with the corresponding electrical contacts b of the apparatus main assembly 100A, respectively. In other words, as the cartridge CR is installed into the cartridge chamber 100B, the former becomes mechanically and electrically connected to the apparatus main assembly 100A, readying thereby the apparatus 100 for image formation.

(3) Developer Remainder Amount Detecting Device (Developer Remainder Amount Detection System)

As the cartridge CR in the apparatus main assembly 100A is used for image formation, the toner in the container 33 is consumed. Thus, the container 33 is provided with a means for detecting the amount of the developer remainder in the container 33. The detected amount of the developer remainder in the container 33 is compared by the control section 83 with the threshold value preset for informing a user of the remaining service life of the cartridge CR, nearness of the end of the service life of the cartridge CR, or the like information. If the control section 83 determines that the detected amount of the developer remainder in the container 33 is smaller than the preset threshold value, the control section 83 outputs a message which informs a user of the impending or actual end of the service life of the cartridge CR, across the display portion of the control panel 200 of the apparatus 100, or the display portion of the host apparatus 300, prompting the user to prepare a replacement process cartridge, or urging the user to replace the cartridge CR in the apparatus main assembly 100A.

The value of the detected amount of the developer remainder in the container 33 is a referential value which can be used by a user to determine whether or not a replacement cartridge is to be prepared. Thus, if the accuracy with which the amount of the developer remainder in the container 33 is detectable reduces, it is possible that the user may fail to timely prepare a replacement cartridge, and therefore, the apparatus 100 may not be used for a substantial length of time. In particular, the amount of the developer remainder in the container 33, which is detectable just before the toner T in the container 33 is used up is the referential amount for determining whether or not the cartridge CR in the apparatus main assembly 100A can still be used for image formation. Thus, the accuracy with which the amount of the toner T remainder in the cartridge CR is detected just before the toner T is used up is required to be very high. The developer remainder amount detecting device in this embodiment is such a device that successively detects the amount of the toner remainder, and yet, is significantly higher in the accuracy with which it detects the amount of the toner remainder, than any conventional one. Hereafter, this developer remainder amount detecting device is described.

There are two electrodes 1 and 2, that is, the first and second electrodes, in the developer container 33. The two electrodes 1 and 2 are made of stainless steel or the like. They are for detecting the amount of the electrostatic capacity between themselves and an additional electrode in the container 33. They are sized and positioned so that the electrostatic capacity between themselves and the additional electrode is changed by the change in the amount of the toner between themselves and the additional electrode.

In this embodiment, the first electrode 1 is paired with the development sleeve 30, which is an electrically conductive developer bearing member, to form a condenser, and so is the second electrode 2. Further, the first electrode 1 is positioned closer to the development sleeve 30 (third electrode) paired with both the first and second electrodes 1 and 2 than the second electrode 2; the second electrode 2 is positioned further from the development sleeve 30 than the first electrode 1.

In this embodiment, the aforementioned development bias applying means 86 which is for applying development bias to the development sleeve 30 is made to double as a device for applying a developer remainder amount detection voltage to the sleeve 30 as the "additional" electrode. The detection voltage applying device 86 has at least an AC power source 84. In this embodiment, it is a combination of the AC power source 84 and a DC power source 85. The stirring member 32 is positioned so that at least a part of the stirring member 32 is between the second electrode 2 and the development sleeve 30 as the common electrode.

1) Toner Amount Detection by First Electrode 1

The first electrode 1 is in connection to a first electrostatic capacity detecting portion 81, which detects the amount of the first electrostatic capacity, that is, the electrostatic capacity between the development sleeve 30 and first electrode 1. In this embodiment, the first electrostatic capacity detecting portion 81 has an electric current detection circuit which detects the amount of the first AC current, that is, the AC current induced in first electrode 1 as the electrostatic capacity detection voltage, which includes at least AC voltage, is applied to the development sleeve 30. The amount of the first AC current which is in the form of analogue signal and is detected by the first electrostatic capacity detecting portion 81, is converted into digital signals (A/D conversion), and is inputted into a processor 83*a* (developer remainder detector) provided in the control section 83.

The amount of the first electrostatic capacity, that is, the electrostatic capacity between the development sleeve 30 and first electrode 1, is affected by the amount of toner between the development sleeve 30 and first electrode 1. More concretely, as the toner between the development sleeve 30 and first electrode 1 reduces, the first electrostatic capacity reduces.

The changes in the amount of the first electrostatic capacity affects the amount by which the first AC current is induced in the first electrode 1 by the electrostatic capacity detection voltage (which hereafter may be referred to simply as "detection voltage") applied to the development sleeve 30. More concretely, as the first electrostatic capacity reduces, the first AC current reduces in proportion to the amount of the first electrostatic capacity. Therefore, the amount of the first electrostatic capacity can be detected by detecting the amount of the first AC current. Hence, the amount of the toner between the development sleeve 30 and first electrode 1 can be obtained from the detected amount of the first electrostatic capacity.

In connection to the control section 83 is the first storage means 87, which the apparatus main assembly 100A has and is a re-writable nonvolatile memory. The first storage means 87 stores the first table which shows the relationship between the amount of the toner in the container 33 and the first electrostatic capacity. Thus, the control section 83 determines the amount of the toner in the container 33, by comparing this table with the results (output) of the first electrostatic capacity detecting portion 81.

In the following description of the preferred embodiments of the present invention, the first PAF and second PAF stand for the values of the first and second electrostatic capacities, that is, the values of the first and second electrostatic capacities, respectively, when the cartridge is in the brand-new condition (full of toner). They correspond to P and Q in FIG. 4. The absolute value of the first electrostatic capacity, and that of the second electrostatic capacity, are affected by the nonuniformity among image forming apparatuses (apparatus main assembles 100A), in terms of the detection voltage, detecting means, etc. Thus, the amount of difference between the first PAF and the successively detected amount of electrostatic capacity is obtained. Then, the amount by which the toner in the container 33 reduced since the cartridge CR was put to use for the first time is obtained to eliminate the effects of the aforementioned nonuniformity.

In this embodiment, the first PAF, which is the results (output) of the detection by the first electrostatic capacity detecting portion 81 when the cartridge CR is brand-new is stored in the second storage means 43 which also is the re-writable nonvolatile memory of the cartridge CR. Then, the amount of the toner in the container 33 is determined based on the difference between the stored first PAF and the result of the successive detection by the first electrostatic capacity detecting portion 81. The method for determining the amount of the toner in the container 33 based on the difference between the first PAF and the result of the successive detection by the fist electrostatic capacity detecting portion 81 remains stable in the detection accuracy even if the first electrostatic capacity becomes unstable due to the fluctuation in the detection voltage, or the like.

The first table contains the information which shows the relationship between the amount of the toner in the container 33, and the amount of the difference between the first PAF and the result of the detection by the first electrostatic capacity detecting portion 81. This subject will be described later in detail.

2) Toner Amount Detection by Second Electrode 2

The second electrode 2 is in connection to the second electrostatic capacity detecting portion 82, which detects the amount of the second electrostatic capacity, which is the electrostatic capacity between the developer bearing member 30 and second electrode 2. In this embodiment, the second electrostatic capacity detecting portion 82 includes an electric current detection circuit for detecting the amount of the second AC current, that is, the AC current induced in the second electrode 2 as the detection voltage, which includes at least AC voltage, is applied to the development sleeve 30. The amount of the second AC current (analog signal) detected by the second electrostatic capacity detecting portion 82 is converted into digital signals (A/D conversion), and is inputted into the processor 83*a*.

The amount of the second electrostatic capacity, that is, the electrostatic capacity between the development sleeve 30 and the second electrode 2, is affected by the amount of the toner between the development sleeve 30 and second electrode 2. More concretely, as the toner between the development sleeve 30 and second electrode 2 reduces, the second electrostatic capacity reduces.

The first storage means 87 stores the second table which shows the relationship between the amount of the toner in the container 33 and the amount of the second electrostatic capacity. The control section 83, which has the CPU, compares the second table with the result of the detection by the second electrostatic capacity detecting portion 82, and determines the amount of the toner in the container 33, based on the result of the comparison.

In this embodiment, the second PAF obtained by the second electrostatic capacity detecting portion 82 right after the cartridge CR was put to use for the first time, is also stored in the second storage means 43 of the cartridge CR, which is a re-writable nonvolatile memory. Then, the amount of the toner in the container 33 is determined based on the amount of the difference between the second PAF and the result of the successive detections by the second electrostatic capacity detecting portion 82. A method for determining the amount of the toner in the container 33 based on the amount of difference between the second PAF and the successive detections by the second electrostatic capacity detecting portion 82 remains stable in the detection accuracy even if the second electrostatic capacity is made to fluctuate by the fluctuation of the detection voltage.

The second table contains the information which shows the relationship between the amount of the toner in the container 33, and the amount of the difference between the second PAF and the result of detection by the second electrostatic capacity detecting portion 82. This subject will be described later in detail.

3) Correction of Detection Results

In a case where two pairs of electrodes 1-30 and 2-30 are in the developer container 33, and are measured in the amount of electrostatic capacity, the amount of the electrostatic capacity of one of the two pairs of electrodes is affected by the amount of the electrostatic capacity of the other pair. That is, the increase in the amount of electrostatic capacity of one pair reduces the other pair in the amount of electrostatic capacity. On the contrary, the decrease in the amount of electrostatic capacity of one pair increases the other pair in the mount of electrostatic capacity. In other words, in a case where two electrodes in which electric current can be induced by the detection voltage (which includes AC voltage) are in the container 33, the amount by which electric current is induced by the detection voltage is divided between the two electrodes in proportion to the amount of their electrostatic capacity. That is, one of the two pairs increases in electrostatic capacity, it becomes greater in the amount by which electric current is induced by the detection voltage, the other becomes smaller in the amount by which electric current is induced by the detection voltage.

Figure 3:
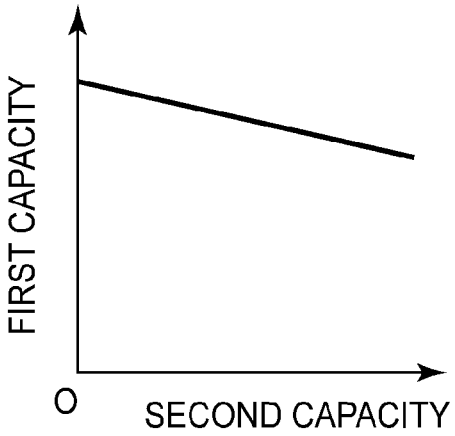
FIG. 3 is a graph which shows the relationship between the amount of the first electrostatic capacity and the amount of the second electrostatic capacity.

FIG. 3 is a drawing which shows the relationship between the amount of the second electrostatic capacity and the amount of the first electrostatic capacity. The amount of the toner in the container 33 remained roughly the same, and the amount of the second electrostatic capacity was changed by changing the second electrode 2 in size. Where the amount of the second electrostatic capacity is zero in FIG. 3 corresponds to the amount of the first electrostatic capacity when the second electrode 2 was not provided. As is evident from FIG. 3, even thought the container 33 is kept roughly the same in the amount of the toner therein, the amount of the first electrostatic capacity reduced as the amount of the second electrostatic capacity increased. Also as is evident from FIG. 3, the changes in the amount of the second electrostatic capacity affect the amount of the first electrostatic capacity, even if the amount of the toner between the development sleeve 30 and first electrode 1 remains the same.

In a case where the amount of the first AC current and the amount of the second AC current are detected while the detection voltage which includes AC voltage is being applied as in this embodiment, the AC current induced by the detection voltage is separated into the AC current which is induced in the first electrode 1 and the AC current which is induced in the second electrode 2, and the amount by which the AC current is induced in the first electrode 1 is affected by the first electrostatic capacity, whereas the amount by which the AC current is induced in the second electrode is affected by the second electrostatic capacity. Thus, even if the amount of the toner in the container 33 remains the same, the increase in the amount of the second AC current causes the amount of the first AC current to reduce.

In FIG. 3, the second electrostatic capacity was changed in the amount by changing the second electrode 2 in size, for convenience sake. However, the relationship between the amount of the first electrostatic capacity and second electrostatic capacity shown in FIG. 3 holds true even if the second electrostatic capacity change in amount for a reason other than the change in the size of the second electrode 2. For example, the relationship between the amount of the first electrostatic capacity and that of the second electrostatic capacity, shown in FIG. 3, holds true even in the case where the second electrostatic capacity is changed by the displacement of the second electrode 2, and/or the change in the electrostatic capacity of the stirring member 32 and/or the like, in the container 33.

As described above, the shortest distance between the second electrode 2 and development sleeve 30 is greater than the shortest distance between the first electrode 1 and development sleeve 30. Therefore, the second electrode 2 is more liable to be affected by the other members than the development sleeve 30 in the container 33. In a case where the rotatable stirring member 32 for stirring the toner T is between the development sleeve 33 and second electrode 2 as in this embodiment, the stirring member 32 causes the second electrostatic capacity to fluctuate, because not only is the electrostatic capacity of the second electrostatic capacity affected by the material for the stirring member 32, but also, it is made to fluctuate by the rotation of the stirring member 32. Further, the fluctuation in the amount of the second electrostatic capacity caused by the stirring member 32 affects the amount of the first electrostatic capacity.

The first electrostatic capacity is used to detect the amount of the toner in the container 33 when the container 33 is about to run out of the toner T, and also, when the amount of the toner T in the container 33 is relatively small. The second electrostatic capacity is used to detect the amount of the toner T in the container 33 when the amount of the toner T in the container 33 is relatively large.

By successively detecting the amount of the second electrostatic capacity, it is possible to successively detect the amount of the toner T in the container 33, starting from when the amount of the toner in the container 33 is relatively large to when the container 33 runs out of the toner. However, the fluctuation in the amount of the second electrostatic capacity causes the amount of the first electrostatic capacity to fluctuate. The fluctuation in the amount of the first electrostatic capacity, which is attributable to the fluctuation in the amount of the second electrostatic capacity reduces the accuracy with which the amount of the toner in the container 33 is detectable when the amount of the toner in the container 33 is relatively small. In particular, the accuracy with which the amount of the toner in the container 33 is detected when the container 33 is just about to run out of the toner T is required to be higher than that when the amount of the toner T in the container 33 is relatively large, because the amount of the toner in the container 33, which is detected when the container 33 is just about to run out of the toner is the referential amount, which is to be used to determine whether or not the current cartridge CR is still usable.

Thus, the result of the detection of the first electrostatic capacity has to be corrected in consideration of the effects of the second electrostatic capacity upon the first electrostatic capacity.

In other words, by compensating the result of the detection of the first electrostatic capacity, for the effect that the second electrostatic capacity has upon the first electrostatic capacity as shown in FIG. 3, the amount of the toner in the container 33 can be detected at a higher level of accuracy.

Figure 4:
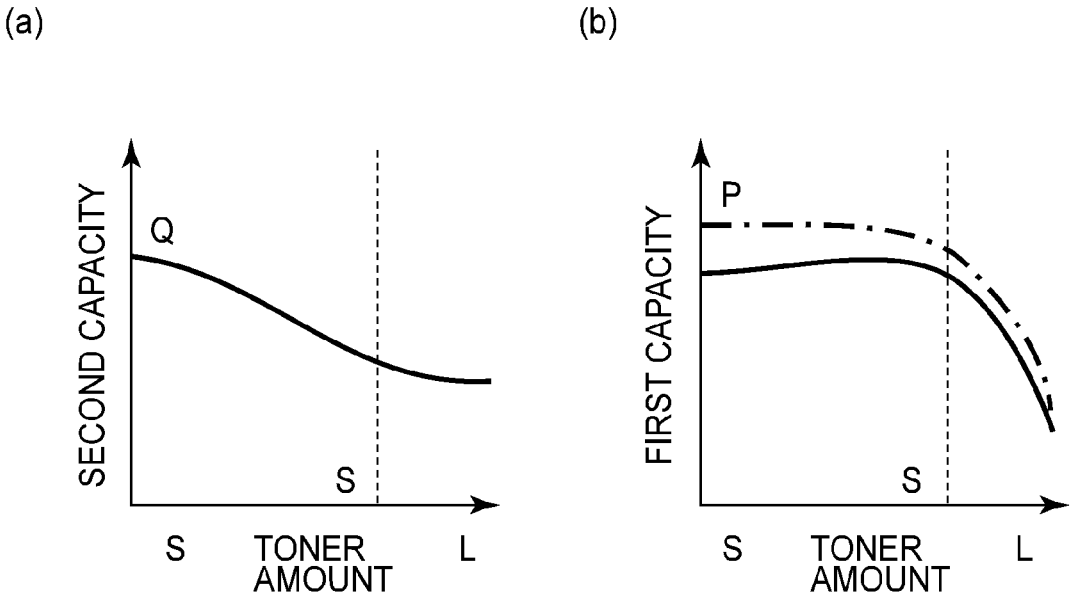
FIG. 4(*a*) is a graph which shows the relationship between the amount of the developer container and the amount of the second electrostatic capacity, and FIG. 4(*b*) is a graph which shows the relationship between the amount of the developer in the developer container and the amount of the first electrostatic capacity.

FIG. 4(*a*) shows the relationship between the amount of the toner in the container 33 and the second electrostatic capacity. There is the first electrode 1 along with the second electrode 2 in the container 33. As the toner T in the container 33 reduces due to consumption, the second electrostatic capacity also reduces. After the amount of the toner T in the container 33 reduces below the amount S indicated by a broken line in FIG. 4(*a*), the second electrostatic capacity reduces in the amount by which it changes (reduces). Therefore, it is difficult to accurately determine the amount of the toner in the container 33 based on only the second electrostatic capacity, when the container 33 is just about to run out of the toner therein.

FIG. 4(*b*) shows the relationship between the amount of the toner in the container 33, and the first electrostatic capacity. The solid line in FIG. 4(*b*) stands for the changes in the first electrostatic capacity, which occurred when there were both the first electrode 1 and second electrode 2 in the container 33, whereas the single-dot chain line stands for the changes in the amount of the first electrostatic capacity, which occurred when the container 33 did not contain the second electrode 2, that is, when there was only the first electrode 1 in the container 33. Referring to the solid line and single-dot line in FIG. 4(*b*), when the amount of the toner in the container 33 is no less than the amount S indicated by the broken line, the amount by which the first electrostatic capacity is affected by the amount of the toner in the container 33 is not significant. However, as the amount of the toner in the container 33 falls below the amount S, the amount of the first electrostatic capacity suddenly begins to reduce roughly in proportion to the amount of the reduction in the amount of the toner in the container 33. Thus, the first electrostatic capacity is very useful to determine the amount of the toner in the container 33 when the container 33 is about to run out of the toner.

The amount of difference between the solid line and single-dot chain line is attributable to the aforementioned effect of the second electrostatic capacity. Thus, the amount of the toner in the container 33 when the container 33 is about to run out of the toner can be determined at a higher level of accuracy by compensating for this difference.

In this embodiment, when the amount of the toner in the container 33 is no less than the amount S, the result of the electrostatic capacity detection by the second electrostatic capacity detecting portion 82 is used to determine the amount of the toner in the container 33, whereas when the amount of the toner in the container 33 is no more than the amount S, the result of the electrostatic capacity detection by the first electrostatic capacity detecting portion 81 is used. However, the result of the detection by the first electrostatic capacity detecting portion 81 is compensated for the effect of the second electrostatic capacity, based on the result of the detection by the second electrostatic capacity detecting portion 82.

More concretely, the compensation is to be made so that the following mathematical equation is satisfied:

$$X=aY+Z$$

X: amount obtained by compensating detected amount of first electrostatic capacity for effect of second electrostatic capacity Y: detected amount of second electrostatic capacity Z: detected amount of first electrostatic capacity a: preset constant stored in the first storage means 87.

In this embodiment, the constant a is set so that when the container 33 does not have the second electrode 2, the value of X is roughly the same as the value of Z. However, the mathematical formula for the compensation does not need to limited to the one given above. All that is necessary is that the detected amount Z of the first electrostatic capacity is compensated for the effect of the second electrostatic capacity, based on the detected amount Y of the second electrostatic capacity.

4) Toner Remainder Amount Detection Sequence

Figure 5:
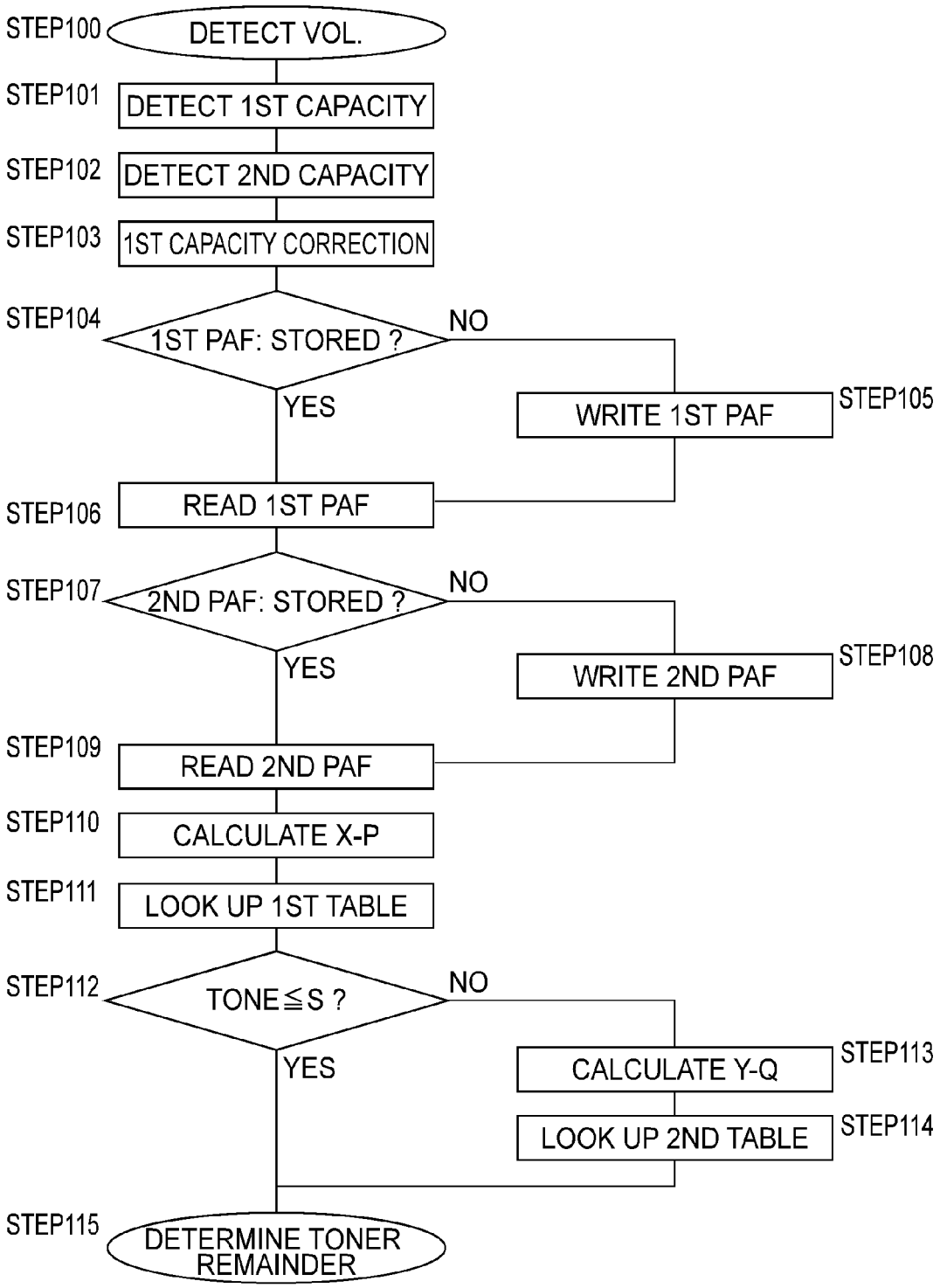
FIG. 5 is a flowchart of the developer remainder amount detection sequence in the first preferred embodiment.

Next, referring to FIG. 5, the toner remainder amount detection sequence in this embodiment is described. First, the detection voltage, which includes AC voltage is applied to the development sleeve 30 in STEP 100. In this embodiment, the development voltage source is also used as the detection voltage source as described above. Using the development voltage source as the detection voltage source makes it possible to detect the amount of the toner in the container even during an image forming operation. In other words, the amount of the toner remainder in the container 33 can be detected real-time, which is preferable. However, it is not mandatory that the development voltage source is used as the detection voltage source.

Next, the amount Z of the first electrostatic capacity is detected in STEP 101, and the amount Y of the second electrostatic capacity is detected in STEP 102. Then, the constant a in the first storage means 87 is read in STEP 103. Then, the amount X for the first electrostatic capacity is obtained by compensating the detected amount of the first electrostatic capacity, for the effect of the second electrostatic capacity, based on the detected amount Y of the second electrostatic capacity. As described above, the mathematical formula to be used for the compensation is: $X=aY+Z$.

Next, it is determined in STEP 104 whether or not the first PAF is in the second storage means 43. The first PAF (which hereafter may be referred to simply as P) is the value of the adjusted first electrostatic capacity X when the cartridge CR is brand-new, that is, when the amount of the toner in the container 33 is largest. If the first PAF is in the second storage means 43, the processor 83*a* proceeds to STEP 106, in which it reads the first PAF. If the first PAF is not in the second storage means 43, the processor 83*a* proceeds to STEP 106, in which it writes the value of the first electrostatic capacity X adjusted in STEP 103, into the second storage means 43. Then, the processor 83*a* proceeds to STEP 106, in which it reads the first PAF written in the second storage means 43.

Then, the processor 83*a* determines in STEP 107 whether or not the second PAF is in the second storage means 43. The second PAF (which hereafter may be referred to simply as Q) is the value of the second electrostatic capacity Y when the cartridge CR is brand-new, that is, when the amount of the toner in the container 33 is largest. If the second PAF is in the second storage means 43, the processor 83*a* proceeds to STEP 109, in which it reads the second PAF. If the second PAF is not in the second storage means 43, the processor 83*a* proceeds to STEP 108, in which it writes the amount of the second electrostatic capacity Y detected in STEP 102, in the second storage means 43. Then, the processor 83*a* proceeds to STEP 109, in which it reads the second PAF written in the second storage means 43.

Figure 6:
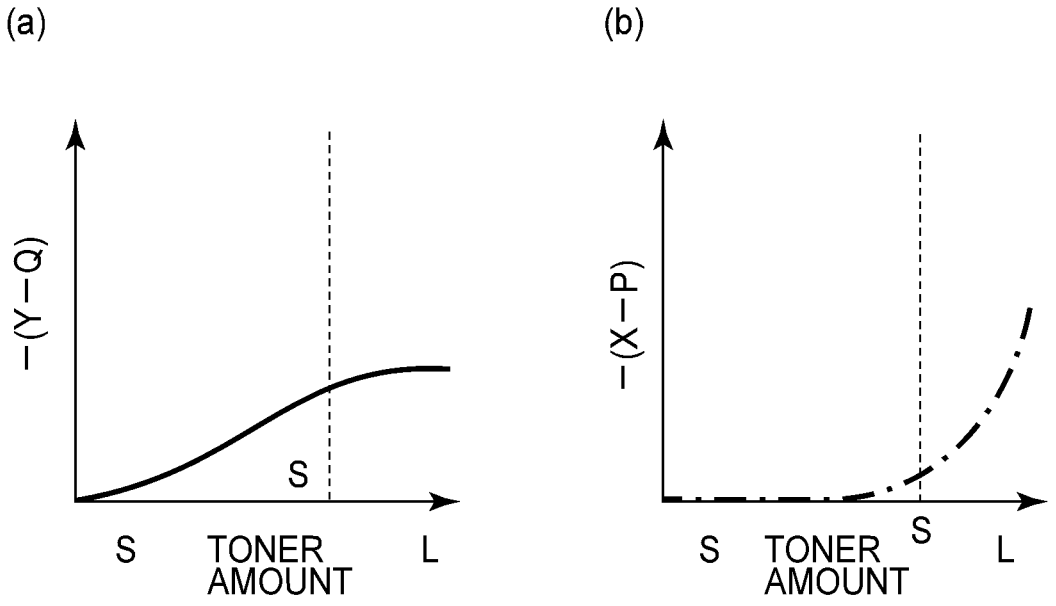
FIG. 6(*a*) is a graph which shows the relationship between the amount of the toner in the container 33 and the second PAF (Y−Q), and FIG. 6(*b*) is a graph which shows the relationship between the amount of the toner in the container 33 and the first PAF (X-P).

Next, the processor 83*a* obtains in STEP 110 the amount of the difference between the adjusted amount X of the first electrostatic capacity and the first PAF (X-P). Then, the processor 83*a* compares, in STEP 111, the first table in the first storage means 87, with (X-P), that is, the amount of difference between the adjusted amount X of the first electrostatic capacity and first PAF, obtaining thereby the amount of the toner in the container 33. Here, the first table is a table which shows the relationship between the amount of the toner in the container 33 and (X-P). That is, FIG. 6(*b*) shows the relationship between the amount of the toner in the container 33 and (X-P), and this relationship is stored as the first table in the first storage means 87.

Next, the processor 83*a* determines in STEP 112 whether or not the amount of the toner in the container 33, which was obtained in STEP 111, is no more than the amount S, which was preset as the maximum amount which can be accurately detected, as the amount of the toner in the container 33, by the first electrostatic capacity detecting portion 81. If the amount of the toner detected in STEP 111 is no more than the amount S, the processor 83*a* proceeds to STEP 115, in which it determines that the amount detected as the amount of the toner in the container 33 in STEP 111 is the same as the actual amount of the toner in the container 33. If the amount detected as the amount of the toner in the container 33 in STEP 111 is no less than the amount S, the processor 83*a* proceeds to STEP 113.

In STEP 113, the processor 83*a* obtains the amount (Y−Q) of the difference between the amount of the second electrostatic capacity Y and the second PAF. Then, it proceeds to STEP 114, in which it obtains the amount of the toner in the container 33 by comparing the second table in the first storage means 87 with the amount (Y−Q) of the difference between the amount of the second electrostatic capacity Y and the second PAF. Here, the second table is such a table that shows the relationship between the amount of the toner in the container 33 and (Y−Q). This relationship is stored as the second table in the first storage means 87.

Then, the processor 83*a* proceeds to STEP 115, in which it determines that the amount of the toner obtained in STEP 114 is equal to the actual amount of the toner in the cartridge CR. The amount of the toner determined in STEP 115 is displayed on the display portion of the control panel 200 of the apparatus main assembly 100A, or the display portion of the host apparatus 300. Further, the processor 83*a* displays the remaining length of the service life of the cartridge CR or imminent ending of the service life of the cartridge CR. Further, the remaining amount of the toner in the container 33 is written into the second storage means 43 of the cartridge CR.

The summary of the above-described toner remainder amount detection sequence is as follows. The processor 83*a* determines the amount of the developer in the container 33, based on the value obtained by compensating the result of the detection by the first electrostatic capacity detecting portion 81, for the effect of the second electrostatic capacity, based on the result of the detection by the second electrostatic capacity detecting portion 82. The compensation is such that the detected amount of the first electrostatic capacity is increased, and the amount by which the detected amount of the first electrostatic capacity is compensated (increased) for the effect of the second electrostatic capacity is determined based on the detected amount of the second electrostatic capacity. That is, the compensation is such that the value obtained by compensating the detected amount of the first electrostatic capacity, for the effect of the second electrostatic capacity, becomes roughly the same as the amount of the electrostatic capacity between the first electrode 1 and common electrode 30, that is, development sleeve 30, when the amount of the electrostatic capacity between the second electrode 2 and common electrode 30.

Figure 7:
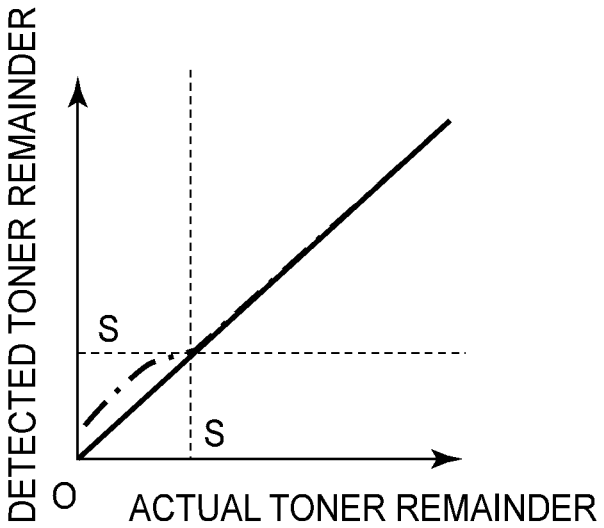
FIG. 7 is a graph which shows the relationship between the detected amount of the developer remainder in the developer container and the actual amount of the developer remainder in the developer container.

FIG. 7 shows the result of the toner remainder amount detected with the use of the method in this embodiment, and the result of the toner remainder amount determination with the use of a comparative method which does not compensate the result of the detection of the first electrostatic capacity by the first electrostatic capacity detecting portion 81, for the effect of the second electrostatic capacity; it shows the relationship between the actual amount of the toner in the container 33 and the determined amount of the toner in the container 33. When the toner remainder amount was determined with the use of the method in this embodiment, the actual amount of the toner in the container 33 had virtually one to one relationship with the determined amount of the toner, as indicated by a solid line. In other words, the toner remainder amount detecting method in this embodiment made it possible to always detect the mount of the toner in the container 33 at a high level of accuracy. In comparison, in the case the comparative method, the toner remainder amount was determined without compensating the result of the detection of the amount of the first electrostatic capacity by the first electrostatic capacity detecting portion 81, for the effect of the second electrostatic capacity. Thus, the amount of the toner in the container 33 could not be determined at a high level of accuracy when the amount of the toner in the container 33 is small.

As described above, this embodiment of the present invention made it possible to provide an image forming apparatus which can successively determine the amount of the toner in its developing device, and is significantly higher in the accuracy with which it can determine the toner remainder amount in the developing device when the developing device is about to run out of the toner therein, than any image forming apparatus in accordance with the prior art.

Embodiment 2

Next, the second preferred embodiment of the present invention is described. Users of an image forming apparatus which employ the cartridge CR are different in what they expect of the cartridge CR. Those who frequently use an image forming apparatus desire to minimize the length of time and labor required to replace a cartridge. Therefore, the larger is a cartridge in toner capacity, the better. In comparison, those who do not frequently use an image forming apparatus are relatively small in the amount of toner consumption. Therefore, they prefer a cartridge which is inexpensive and lighter.

Thus, image forming apparatus manufactures offer image forming apparatuses which can be used with multiple types of cartridges, which are different in toner capacity. This embodiment is described with reference to an image forming apparatus which can be used with not only the cartridge (which hereafter will be referred to as cartridge A) in the first preferred embodiment, but also, a cartridge B which is greater in toner capacity than the cartridge A.

Figure 8:
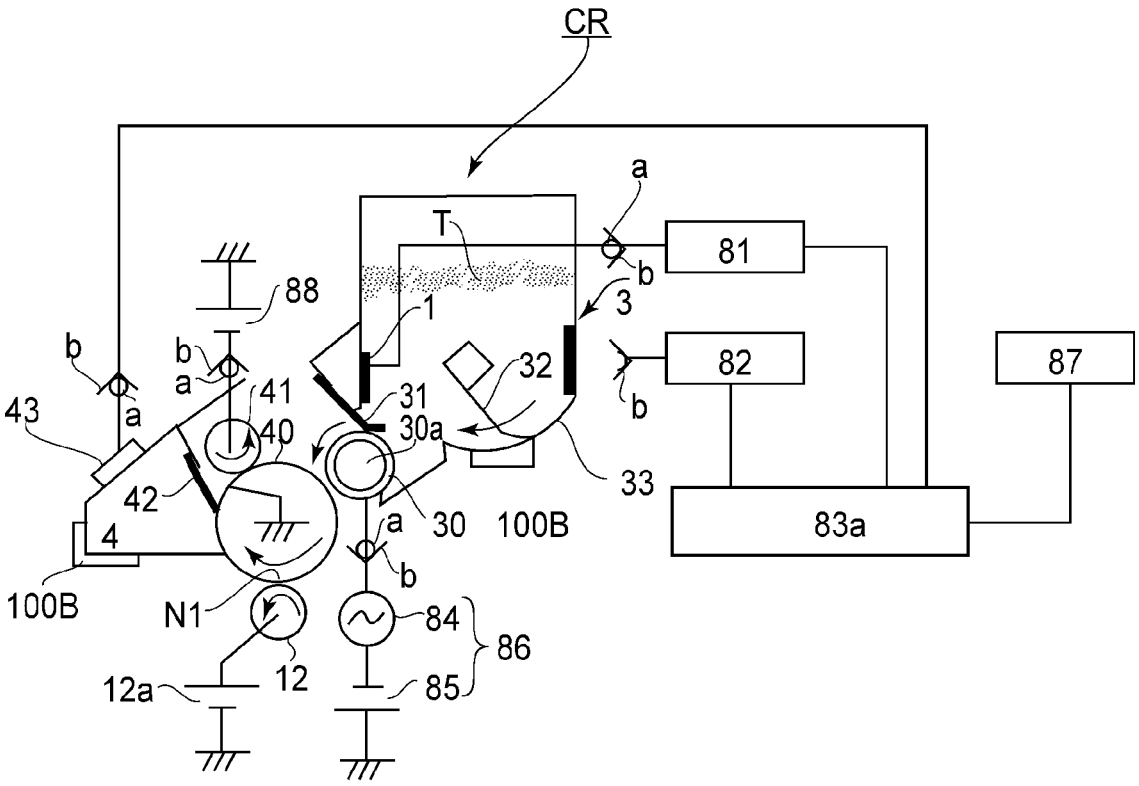
FIG. 8 is a combination of the process cartridge and its adjacencies in the image forming apparatus and a block diagram of the control system of the apparatus, in the second preferred embodiment of the present invention.

The amount of the toner in the cartridge B when the cartridge B is brand-new is the same as the amount S, which is the maximum amount of toner in the cartridge A, which can be accurately determined with the use of the first electrostatic capacity detecting portion 81. Needless to say, it does not need to be limited to the amount S. Referring to FIG. 8 which shows the general structure of the cartridge B and the general structure of the image forming apparatus in this embodiment, the cartridge B is not provided with the second electrode. Otherwise, it is the same in structure as the cartridge A. Since the cartridge B does not have the second electrode, the second electrostatic capacity detecting portion 82 is not in connection to the second electrode. Therefore, the result of the detection by the second electrostatic capacity detecting portion 82 is always zero. That is, the amount of electrostatic capacity detected by the second electrostatic capacity detecting portion 82 is roughly zero.

The maximum toner capacity of the cartridge B is equal to the amount S. Therefore, the cartridge B does not require the second electrode 2. Even if the cartridge B is greater in toner capacity than the amount S, it does not require the second electrode as long as the amount of the toner in the cartridge B is not detected when the amount of the toner in the cartridge B is greater than the amount S. Since the cartridge B does not require the second electrode, it is cheaper than a cartridge which requires the second electrode.

Next, the method, in this embodiment, for compensating the result of the detection of the first electrostatic capacity for the effect of the second electrostatic capacity is described. The result of the detection by the first electrostatic capacity detecting portion 81 is compensated for the effect of the second electrostatic capacity, based on the result of the detection by the second electrostatic capacity detecting portion 82. More concretely, it is compensated so that an equation ($X=aY+Z$) is satisfied, in which X stands for the corrected amount of the first electrostatic capacity; Z stands for the amount of the first electrostatic capacity prior to the correction; and a is a constant, which is preset and stored in the first storage means 87. The equation for the compensation does not need to be limited to the one given above.

In this embodiment, the constant a is preset so that the corrected amount X of the first electrostatic capacity of the process cartridge A becomes roughly the same as the amount Z of the first electrostatic capacity of a cartridge (A) which does not have the second electrode 2. By compensating the detected amount of the first electrostatic capacity for the effect of the second electrostatic capacity so that the compensated amount of the first electrostatic capacity becomes the same as the amount of the second electrostatic capacity when there is no second electrode, it is possible to make the process cartridge A which has the second electrode, the same as the process cartridge B which does not have the second electrode, in terms of the post-compensation amount X of the first electrostatic capacity. Incidentally, after the compensation, the amount X of the first electrostatic capacity of the cartridge B is roughly the same as the pre-compensation amount Z of the first electrostatic capacity, because the amount Y of the second electrostatic capacity is virtually zero.

As long as the compensation is made as described, even when the cartridge B is used, the first and second tables to be stored in the first storage means 87 are the same as those to be stored when the process cartridge A is used.

Otherwise, the second embodiment is the same as the first embodiment in terms of the structure and control of the image forming apparatus. Therefore, the structural components of the image forming apparatus in this embodiment, which are the same as the counterparts of the image forming apparatus in the first embodiment are given the same referential codes as those given to the counterparts, and are not going to be described in detail.

Even when the cartridge B is used, the toner remainder amount can be detected at the same high level of accuracy as that at which it can be detected when the cartridge A is used.

As described above, this embodiment of the present invention makes it possible to provide an image forming apparatus which is usable with multiple types of cartridge, which are different in toner capacity, and can successively detect the amount of the toner remainder of the cartridge in use, at a significantly higher level of accuracy than any image forming apparatus in accordance with the prior art, regardless of the toner capacity of a cartridge, in particular, when the cartridge is about to run out of toner.

Further, not only can this embodiment of the present invention improve a cartridge having two pairs of electrodes for detecting the amount of the toner in the cartridge, but also, a cartridge having only a single pair of electrodes for detecting the amount of the toner in the cartridge, in terms of the accuracy with which the amount of the toner in the cartridge can be determined.

Further, this embodiment makes it possible to determine the amount of the toner in a cartridge having only a single pair of electrodes for the toner remainder amount detection, at a significantly higher level of accuracy than the level of accuracy at which any combination of an image forming apparatus and a process cartridge, which are in accordance with the prior art. Thus, it makes it possible to provide a combination of a process cartridge and an image forming apparatus, which is significantly lower in cost than that in accordance with the prior art.

Further, this embodiment of the present invention makes it unnecessary to provide an image forming apparatus with two tables to be stored in storage means, even if the apparatus can accommodate two types of cartridge. In other words, this embodiment can reduce an image forming apparatus in the amount of the memory of the storage means. That is, it can provide an image forming apparatus which can accommodate two types of cartridge different in toner capacity, and is significantly lower in cost than any image forming apparatus in accordance with the prior art, which can accommodate two types of cartridge different in toner capacity.

Embodiment 3

Figure 9:
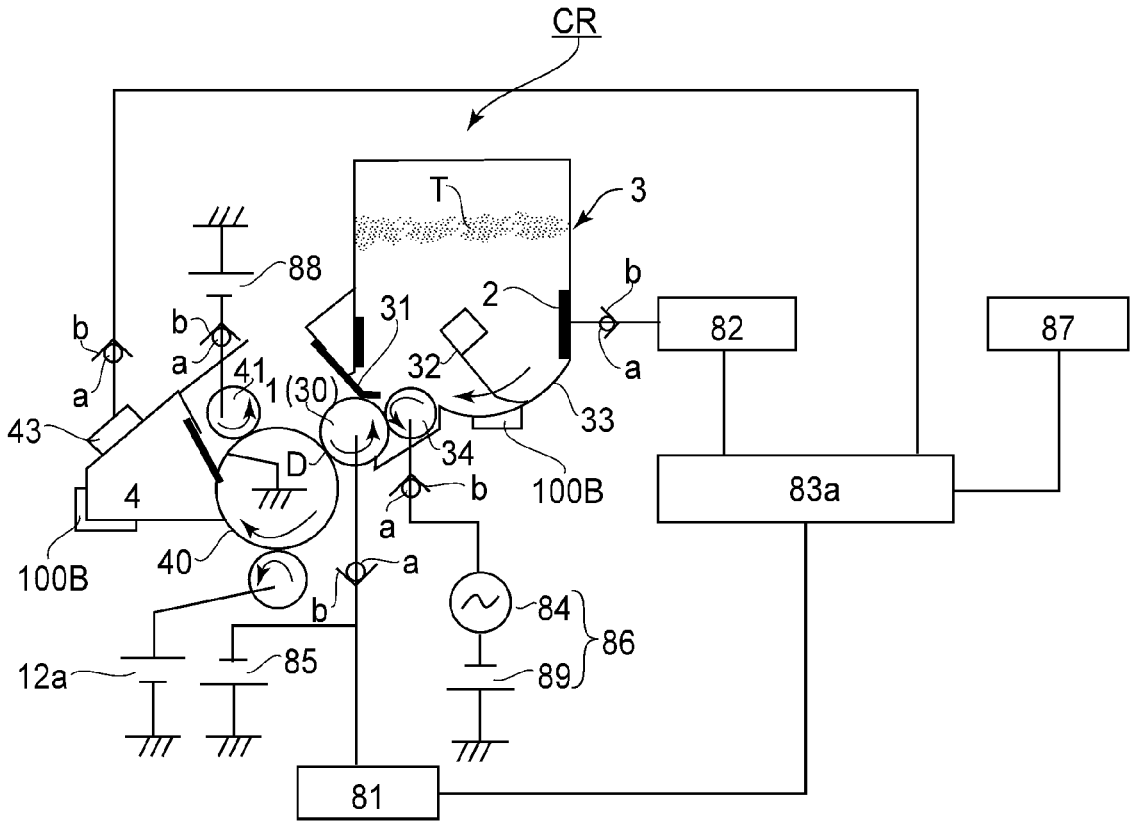
FIG. 9 is a combination of the process cartridge and its adjacencies in the image forming apparatus, and a block diagram of the control system of the apparatus, in the third preferred embodiment of the present invention.

Next, the third preferred embodiment of the present invention is described. FIG. 9 is a combination of a schematic sectional view of the image forming apparatus, including the cartridge therefor, and its system for determining the amount of the toner remainder in the cartridge.

In this embodiment, the drum 40, charge roller 41, cleaning device 4, developer bearing member 30 (which doubles as first electrode 1), developer layer thickness regulating member 31, developer supplying member 34, developer stirring member 32, and developer container 33 are unitized in the form of a cartridge (process cartridge CR), in which the toner T is storable. Further, the cartridge CR is provided with a second electrode 2 and a storage means 43. The developer bearing member 30 (development roller) doubles as the first electrode 1. It is made up of an electrically conductive roller (as substrate), and an elastic layer which is formed of a semiconductive substance such as urethane rubber and covers the entirety of the peripheral surface of the roller. It bears and conveys the toner T. The toner T is single-component toner, and is electrically nonconductive and nonmagnetic. The development sleeve 30 is positioned so that its peripheral surface is in contact with the peripheral surface of the drum 40. That is, it develops an electrostatic latent image on the peripheral surface of the drum 40, by being placed in contact with the drum 40. To the development roller 30, a development voltage 85, which is a DC voltage, is applied to develop the electrostatic latent image.

The developer delivery roller 34 (supply roller) doubles as a third electrode. The supply roller 34 is in contact with the development roller 30, and is rotated in such a direction that the peripheral surface of the development roller 30 moves in the opposite direction of the peripheral surface of the development roller 30 in the area of contact between the supply roller 34 and development roller 30, at such a peripheral velocity that a preset amount of the ratio is maintained between the peripheral velocity of the supply roller 34 and development roller 30. Thus, as the supply roller 34 and development roller 30 are rotated, the toner T on the peripheral surface of the supply roller 34 is transferred onto the peripheral surface of the development roller 30. The supply roller 34 is made up of an electrically conductive roller (substrate), and an elastic layer which is formed of an elastic substance such as foamed urethane and covers the entirety of the peripheral surface of the roller. The second electrode 2 is made of stainless steel or the like, as is the second electrode in the first embodiment.

The first electrode 1, as which the development roller 30 doubles, makes up a condenser by being paired with the supply roller 34, which is electrically conductive. Further, the second electrode 2 makes up a condenser by being paired with the supply roller 34. The first electrode 1 is positioned so that the shortest distance between itself, and the supply roller 34 which pairs with both the first and second electrodes 1 and 2, is shorter than the shortest distance between the second electrode 2 and the supply roller 34; the second electrode 2 is positioned so that the shortest distance between itself and the supply roller 34 is greater than the shortest distance between the first electrode 1 and the supply roller 34.

The supply roller 34 is in connection to the detection voltage applying device 84, which has at least an AC voltage applying means 84. In this embodiment, the detection voltage applying device 86 is a combination of an AC voltage power source 84 and a DC voltage power source 89.

The first electrode 1, as which the development roller 30 doubles, is in connection to the first electrostatic capacity detecting portion 81 and developer voltage applying device 85. The second electrode 2 is in connection to the second electrostatic capacity detecting portion 82.

The first electrostatic capacity amount detecting portion 81 detects the amount of the first electrostatic capacity, which is the amount of the electrostatic capacity between the supply roller 34, and the first electrode 1, as which the development roller 30 doubles. The first electrostatic capacity detecting portion 81 in this embodiment is provided with at least an electric current detection circuit which detects the amount of the first AC current induced in the first electrode 1 as the detection voltage, which includes at least AC voltage, is applied to the supply roller 34. The amount (analog signal) of the first AC current detected by the first electrostatic capacity detecting portion 81 is converted into digital signals, and is inputted into the processor 83*a* which has a CPU.

The amount of the first electrostatic capacity, that is, the amount of the electrostatic capacity between the supply roller 34 and development roller 30 (first electrode 1), is affected by the amount of the toner between the supply roller 34 and development roller 30. More concretely, as the toner between the supply roller 34 and development roller 30 reduces, the first electrostatic capacity reduces.

The second electrostatic capacity detecting portion 82 detects the amount of the second electrostatic capacity, that is, the amount of the electrostatic capacity between the supply roller 34 and second electrode 2. The second electrostatic capacity detecting portion 82 in this embodiment is provided with at least an electric current detection circuit which detects the amount of the second AC current induced in the second electrode 2 as the detection voltage, which includes at least AC voltage, is applied to the supply roller 34. The amount (analog signal) of the second AC current detected by the second electrostatic capacity detecting portion 82 is converted into digital signals, and is inputted into the processor 83*a* which has a CPU.

The amount of the second electrostatic capacity, that is, the amount of the electrostatic capacity between the supply roller 34 and second electrode 2, is affected by the amount of the toner between the supply roller 34 and second electrode 2. More concretely, as the toner between the supply roller 34 and second electrode 2 reduces, the second electrostatic capacity reduces.

The structure and control of the image forming apparatus and the cartridge therefor in this embodiment other than those described above are the same as those in the first embodiment. Therefore, the structural components of the image forming apparatus and the cartridge therefor, which are the same in structure as the counterparts in the first embodiment are given the same referential codes as those given to the counterparts, and are not going to be described here.

As will be evident from the description of the present invention given above, this embodiment also makes it possible to provide an image forming apparatus which is capable of successively determining the toner remainder amount at a significantly higher level of accuracy than any comparable image forming apparatus in accordance with the prior art.

[Miscellanies]

1) The application of the present invention is not limited to a process cartridge, such as those in the preceding preferred embodiments of the present invention, that is, a process cartridge of the so-called integration type. That is, the developer remainder amount detecting system in accordance with the present invention can be every effectively applied to a process cartridge of the so-called separation type to detect the amount of the developer remainder in the developer container of the development unit or development cartridge. Further, it can also be very effectively applied to an image forming apparatus which has a built-in developing device and is structured so that developer is delivered into the developer container of the built-in developing device, in order to detect the amount of the developer remainder in the developer container.

2) An image forming apparatus to which the present invention is applicable is not limited to an electrophotographic image forming apparatus. That is, the present invention is also applicable to any image forming apparatus as long as the apparatus has an image bearing member, a latent image forming means for forming a latent image on the image bearing member, and a developing means for developing the latent image with the use of dry and powdery developer. As for the examples of an image bearing member, that is, a member on which a latent image is formed, a dielectric member used for an electrostatic image recording method, a magnetic member for a magnetic image recording method, etc., may be listed, in addition to a photosensitive member for an electrophotographic image forming method.

The image forming apparatuses to which the present invention is applicable include image outputting devices such as copying machines, printers, facsimile machines, and word processors, of the transfer type or direct type. Further, they include the multifunction apparatuses, workstations, etc., which are capable of performing two or more functions of the preceding image forming apparatuses. In the case of an image forming method of the transfer type, a visible image is formed of developer (toner) on an image bearing member, and then, is transferred onto recording medium, directly or by way of an intermediary transfer member. In the case of an image forming method of the direct type, an image is directly formed on recording medium.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 254623/2010 filed Nov. 15, 2010, which is hereby incorporated by reference.

What is claimed is:

1. A detecting system for detecting an amount of developer remainder in a developer container, said detecting system comprising:

first, second and third electrode members provided in said developer container;

a first electrostatic capacity detector for detecting a first electrostatic capacity between said first electrode member and said third electrode member;

a second electrostatic capacity detector for detecting a second electrostatic capacity between said second electrode member and said third electrode member; and a control section configured to determine the amount of the developer remainder based on the second electrostatic capacity and a corrected first electrostatic capacity, with the first corrected electrostatic capacity obtained by compensating the first electrostatic capacity for effect of the second electrostatic capacity, wherein if the control section determines that an amount of the developer corresponding to the corrected first electrostatic capacity is greater than a preset amount, the control section determines the amount of the developer remainder on the basis of the second electrostatic capacity, and if the control section determines that an amount of the developer corresponding to the corrected first electrostatic capacity is not greater than the preset amount, the control section determines the amount of the developer remainder on the basis of the corrected first electrostatic capacity; and wherein said third electrode member is also a developer carrying member for carrying the developer to supply it to the electrostatic latent image.

2. The detecting system according to claim 1, wherein said first electrode member is disposed at such a position that a closest distance from said third electrode member to said first electrode member is smaller than a closest distance from said second electrode member to said third electrode member.

3. The detecting system according to claim 1, further comprising a stirring member for moving the developer in said developer container, wherein at least a part of said stirring member is between said second electrode member and said third electrode member.

4. The detecting system according to claim 1, wherein compensation of the first electrostatic capacity increases the first electrostatic capacity.

5. The detecting system according to claim 1, wherein compensation of the first electrostatic capacity is such that a corrected electrostatic capacity is substantially the same as an electrostatic capacity between said first electrode member and said third electrode member if said second electrode member is not provided.

6. A developer container detecting system comprising:

a developer container accommodating the developer, and the detecting system according to claim 1.

7. The detecting system according to claim 6, wherein said first electrode member, said developer container provided with said second electrode member, and said third electrode member are detachably mountable to a main assembly of an apparatus.

8. An image forming apparatus comprising a process cartridge including an electrophotographic photosensitive drum, a charge roller, a developing device, and a cleaning device, and the detecting system according to claim 1.

9. The detecting system according to claim 1, wherein the first electrostatic capacity and the second electrostatic capacity are detected independently.

10. The detecting system according to claim 1, wherein a correction amount is calculated on the basis of the second electrostatic capacity, and the first electrostatic capacity is compensated for on the basis of the calculated correction amount.

11. The detecting system according to claim 10, wherein the correction amount for compensating the first electrostatic capacity is acquired by $X=a\cdot Y+Z$, where X is the amount obtained by compensating the first electrostatic capacity for effect of the second electrostatic capacity, where Y is the detected amount of the second electrostatic capacity, Z is the detected amount of the first electrostatic capacity, and a is a stored preset constant.

* * * * *